United States Patent [19]

Rock et al.

[11] 4,176,422

[45] Dec. 4, 1979

[54] FURNITURE HINGE

[75] Inventors: Erich Röck, Höchst; Bernhard Mages, Dornbirn, both of Austria

[73] Assignee: Julius Blum Gesellschaft m.b.H., Höchst, Austria

[21] Appl. No.: 902,813

[22] Filed: May 4, 1978

[30] Foreign Application Priority Data

May 11, 1977 [AT] Austria ..... 3349/77

[51] Int. Cl.[2] ..... E05D 7/04

[52] U.S. Cl. ..... 16/130; 16/132

[58] Field of Search ..... 16/129, 130, 131, 132, 16/133, 134, 173, 163, 164, 165

[56] References Cited

U.S. PATENT DOCUMENTS

| | | | |
|---|---|---|---|
| 3,224,035 | 12/1965 | Heinze | 16/131 X |
| 3,863,292 | 2/1975 | Grunert | 16/131 X |
| 4,007,514 | 2/1977 | Salice | 16/129 |

*Primary Examiner*—George H. Krizmanich

*Attorney, Agent, or Firm*—Wenderoth, Lind & Ponack

[57] ABSTRACT

A furniture hinge includes a mounting plate, a hinge arm and a hinge casing, the hinge arm and the casing being connected by means of hinge links. The hinge arm is held on the mounting plate by screws, one screw being an inclined adjusting screw.

2 Claims, 4 Drawing Figures

FURNITURE HINGE

BACKGROUND OF THE INVENTION

1. Field of the Invention

The invention relates to a hinge, particularly for furniture doors, including a hinge arm adapted to carry hinge link axles, the hinge arm being directly or indirectly secured to a mounting plate and carrying a joint-adjusting screw in a female thread, the end of such screw which is directed towards the mounting plate extending into a recess of the mounting plate in the assembled position, such screw said end carrying a ring projection.

2. Description of the Prior Art

Such hinges are frequently used in furniture production, particularly in kitchen furniture production. With such hinges the mounting plate is fastened to a furniture part, e.g. a side-wall, by means of screws, dowels or the like, and the hinge arm is connected with a hinge casing or the like by means of hinge links and is positioned on the mounting plate when putting the furniture door on its hinges.

Thus, pre-assembling of the furniture can be carried out. The mounting plate is first fastened to the furniture side-wall, and then a hinge casing which is linked to the hinge arm is put into a corresponding dowel hole of the furniture door.

Such hinges have to fulfill two essential requirements. When putting the furniture door on its hinges the hinge arm should be quickly anchored and secured to the mounting plate so that the weight of the door need not be carried too long. Moreover, there should be one or several possibilities for adjustment in order to compensate for manufacturing tolerances which may have been caused by drilling the fastening holes in the furniture parts.

It should not be necessary, however, to support or hold the furniture door when carrying out this adjustment.

In order to provide this possibility of joint adjustment, such hinges have a joint-adjusting screw.

Such a joint-adjusting screw is a threaded bolt engaging in a female thread of the hinge arm and having a ring projection on its end directed towards the mounting plate. According to this arrangement the joint adjustment can be obtained by means of one single part. In the assembled position, the ring projection of this joint-adjusting screw rests in a corresponding recess of the mounting plate. In the case of conventional hinges of this type there is a certain clearance between the joint-adjusting screw and the mounting plate which is due to the manufacturing process.

SUMMARY OF THE INVENTION

It is the object of the present invention to avoid such a clearance while maintaining the same manufacturing tolerances.

According to the invention this is achieved by positioning the joint-adjusting screw to be inclined towards a plane which extends at a right angle to the mounting face of the mounting plate and parallel in respect of the hinge link axles.

An angle of about 4° has prooved particularly advantageous.

In order to obtain a perfect fitting of the inclined screw a preferred embodiment of the invention provides that the end of the joint-adjusting screw directed towards the mounting plate is cone-shaped and that the other end or covering of the ring projection directed towards the hinge arm is a truncated cone.

BRIEF DESCRIPTION OF THE DRAWINGS

In the following, an embodiment of the invention will be described in detail with reference to the attached drawings, without being limited thereto, and wherein.

DESCRIPTION OF THE PREFERRED EMBODIMENT

Figure 1:
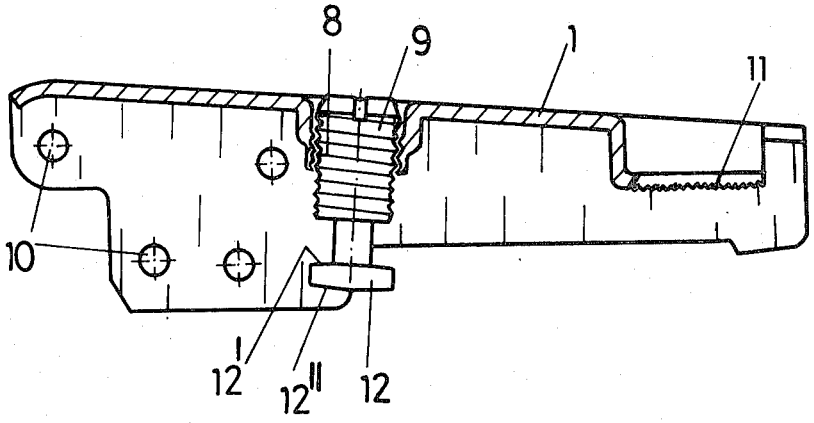
FIG. 1 is a longitudinal section of a hinge arm according to the invention, the mounting plate not being illustrated.

As shown in the drawings, the hinge according to the invention substantially comprises the mounting plate 2 and the hinge arm 1. The hinge arm is connected with the hinge casing by means of a hinge link. The hinge casing is to be inserted into a bore in a furniture door and the mounting plate 2 is to be secured to the other furniture part, e.g. a side-wall of the piece of furniture, by means of supporting screws 3.

Figure 4:
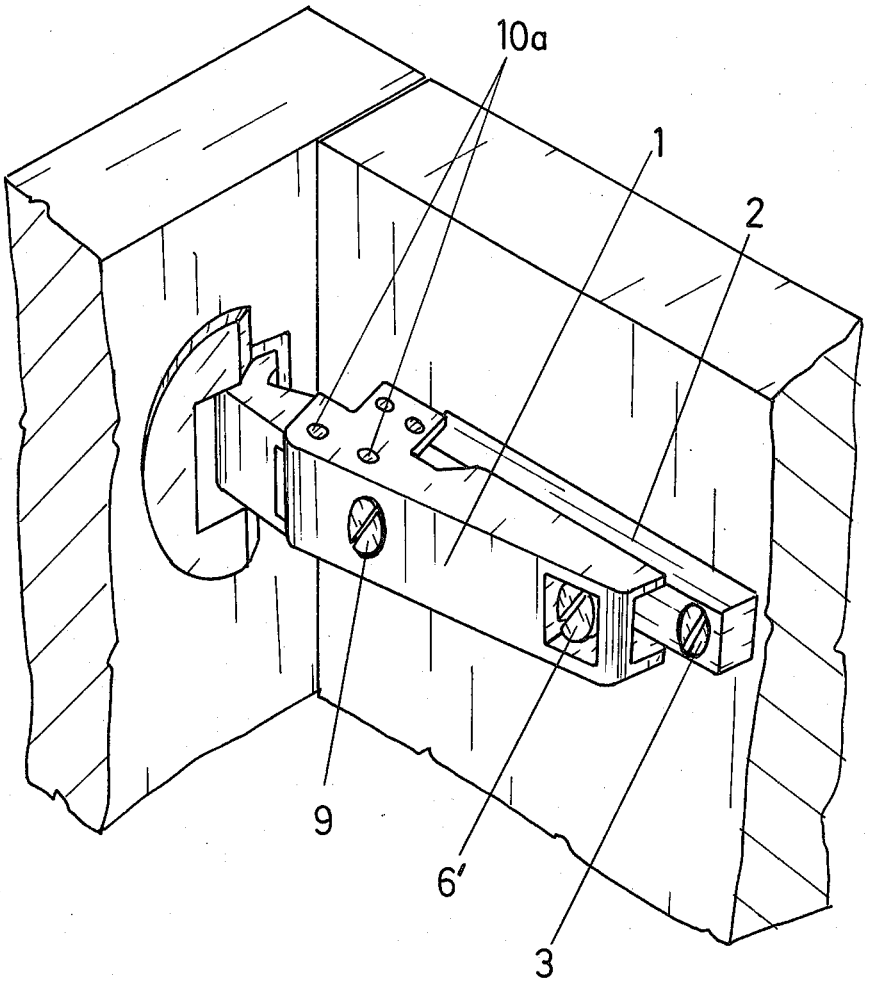
FIG. 4 is a three-dimensional view of the hinge according to the invention.

The hinge casing and the hinge link, as well as the furniture parts, are not illustrated (other than in FIG. 4), as they are in and of themselves do not form the present invention.

Figure 2:
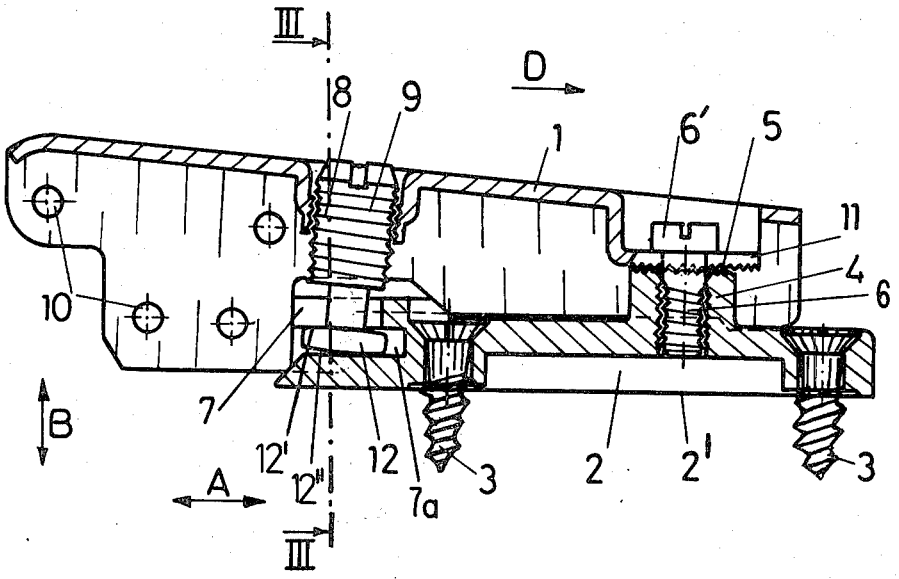
FIG. 2 is a sectional view similar to FIG. 1, but with the mounting plate.

In FIG. 2, the desired possibilities of adjustment are indicated by means of arrows, i.e. arrow A shows the adjusting direction in the depth of the piece of furniture, and arrow B shows the adjusting direction in the door joint.

The mounting face 2' of the mounting plate 2 is secured to the side-wall of the piece of furniture by means of supporting screws 3. The rear portion of the mounting plate 2 has a base 4 with an internal thread 5 into which a fastening screw 6 is screwed. As can particularly be seen in FIG. 3, the front portion of the mounting plate 2 is provided with projections 7 extending longitudinally of the mounting plate and defining therein a T-shaped recess **7*a***.

The hinge arm 1 has a female thread 8 into which a joint-adjusting screw 9 which is a threaded bolt is screwed. Moreover, the end of the hinge arm 1 being directed away from the holes or bearings 10 for supporting the hinge link axles **10*a* of the hinge link has therein a longitudinal slot 11** which is open at the rear side thereof.

When mounting the furniture door, the hinge arm 1 is positioned on the mounting plate 2 in such a way that the head 6' of the fastening screw 6 is positioned above the longitudinal slot 11. Thus the hinge arm 1 is pushed into the direction of arrow D so that a ring projection 12 of the joint-adjusting screw 9 lies below the projections 7 of the mounting plate 2.

Thereby the hinge arm 1 is already anchored to the mounting plate 2 and the furniture door is supported at the same time.

By turning the joint-adjusting screw 9 the adjustment of the hinge in the door joint (arrow B) can be effected. Subsequently the hinge arm 1 can be pushed over a certain portion into the direction of arrow A so that the hinge arm is exactly adjusted with respect to the depth of the piece of furniture. Then the screw 6 is fastened and the hinge arm 1 is fixed accordingly.

By inclining the joint-adjusting screw 9 the clearance which is due to the manufacturing process is reduced or entirely compensated for, and the hinge arm 1 rests securely on the mounting plate 2.

Figure 3:
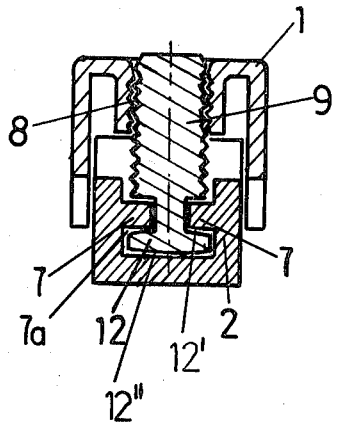
FIG. 3 is a vertical section taken along line III—III of FIG. 2.

In order to improve the fitting of the joint-adjusting screw 9 in the mounting plate 2 the end surface 12'' of the ring-shaped projection or enlarged head 12 of the joint-adjusting screw 9 is cone-shaped and the opposite covering or end surface 12' is a truncated cone. Thus, with the screw 9 inclined, the surfaces 12'' and 12' can adapt to and snugly fit against the upper surface of the bottom of plate 2 and the lower surfaces of projections 7, respectively, as shown in FIGS. 2 and 3, regardless of variations in the dimensions thereof due to manufacturing tolerances.

We claim:

1. A hinge for connecting together two furniture parts, said hinge comprising:

an elongated mounting plate adapted to be attached to a first furniture part along a mounting plane;

said mounting plate having a first longitudinal end adapted to be adjacent and facing a second furniture part when said mounting plate is attached to the first furniture part, said first end of said mounting plate having therein a longitudinally extending T-shaped recess defined by surfaces extending in directions longitudinally of said mounting plate and parallel to said mounting plane;

said mounting plate having a second longitudinal end spaced from said first longitudinal end and adapted to face away from the second furniture part when said mounting plate is attached to the first furniture part, said mounting plate having therein, at a position adjacent said second longitudinal end, an internally threaded bore extending transverse to said mounting plane;

an elongated hinge arm mounted on said mounting plate;

said hinge arm having a first longitudinal end adapted to be adjacent and facing the second furniture part when said hinge arm is mounted on said mounting plate, said first longitudinal end of said hinge arm having therein bearing means for supporting hinge link axles to extend in support directions parallel to said mounting plane and transverse to said surfaces;

said hinge arm having a second longitudinal end spaced from said first longitudinal end of said hinge arm and adapted to face away from the second furniture part when said hinge arm is mounted on said mounting plate, said second longitudinal end of said hinge arm having therein a longitudinally extending slot;

said hinge arm having therein, at a position between said first and second longitudinal ends thereof, an internally threaded bore;

a fastening screw extending through said slot and being threaded into said bore in said mounting plate, such that upon loosening said fastening screw the relative longitudinal position of said hinge arm with respect to said mounting plate may be selectively adjusted;

a joint-adjusting screw having a threaded portion and an enlarged head portion, said threaded portion being threaded into said bore in said hinge arm, said enlarged head portion being longitudinally slidably received in said T-shaped recess of said mounting plate, such that relative rotation of said threaded portion of said joint-adjusting screw with respect to said bore in said hinge arm will change the relative spacing between said first longitudinal end of said hinge arm and said mounting plate; and said enlarge head portion having a first surface facing away from said threaded portion and a second portion facing toward said threaded portion, said first surface comprising a conical surface diverging outwardly toward said threaded portion, said second surface comprising a truncated conical surface diverging outwardly away from said threaded portion, and said bore in said hinge arm and said joint-adjusting screw having coincident axes which are inclined with respect to a plane which extends perpendicular to said mounting plane and parallel to said support directions of said bearing means, such that said conical surface and said truncated conical surface contact opposite of said surfaces defining said T-shaped recess, and said enlarged head portion snugly fits within said recess at all relative positions of said joint-adjusting screw with respect to said hinge arm.

2. A hinge as claimed in claim 1, wherein said coincident axes are inclined with respect to said plane at an angle of approximately 4°.

* * * * *